US008161588B1

(12) United States Patent
Anson

(10) Patent No.: US 8,161,588 B1
(45) Date of Patent: Apr. 24, 2012

(54) ANTI-AGING PILLOW

(75) Inventor: Goesel Anson, Las Vegas, NV (US)

(73) Assignee: JuveRest, LLC, Las Vegas, NV (US)

( * ) Notice: Subject to any disclaimer, the term of this patent is extended or adjusted under 35 U.S.C. 154(b) by 94 days.

(21) Appl. No.: 13/038,200

(22) Filed: Mar. 1, 2011

Related U.S. Application Data

(60) Provisional application No. 61/315,302, filed on Mar. 18, 2010.

(51) Int. Cl.
*A47G 9/00* (2006.01)

(52) U.S. Cl. ..... 5/636; 5/630

(58) Field of Classification Search ..... 5/630, 636, 5/632–633; D6/601
See application file for complete search history.

(56) References Cited

U.S. PATENT DOCUMENTS

| | | | | |
|---|---|---|---|---|
| 4,218,792 | A | 8/1980 | Kogan | |
| 5,018,231 | A | 5/1991 | Wang | |
| D318,203 | S | 7/1991 | Zaghini | |
| D381,233 | S | 7/1997 | Torbik | |
| D388,648 | S | 1/1998 | Bates | |
| 5,708,998 | A | 1/1998 | Torbik | |
| 5,727,267 | A | 3/1998 | Keilhauer | |
| D465,686 | S | 11/2002 | Hwong | |
| D474,364 | S | 5/2003 | Arceiri | |
| 6,574,809 | B1 | 6/2003 | Rathbun | |
| D497,507 | S | 10/2004 | Keilhauer | |
| 6,817,049 | B1 | 11/2004 | Hall | |
| 6,915,539 | B2 | 7/2005 | Rathbun | |
| 7,082,633 | B1 * | 8/2006 | Maarbjerg | 5/636 |
| D529,325 | S | 10/2006 | Maarbjerg | |
| 7,165,279 | B1 | 1/2007 | Georgescu | |
| 7,203,983 | B1 | 4/2007 | Reeves et al. | |
| D558,499 | S | 1/2008 | Maarbjerg et al. | |
| 7,316,041 | B2 | 1/2008 | Guez | |
| 7,516,504 | B2 | 4/2009 | Guez | |
| D634,960 | S * | 3/2011 | Anson | D6/601 |
| 2009/0139031 | A1 | 6/2009 | Davis et al. | |

* cited by examiner

*Primary Examiner* — Fredrick Conley
(74) *Attorney, Agent, or Firm* — Mind Law Firm; Justin G. Sanders; Jeromye V. Sartain

(57) ABSTRACT

An anti-aging pillow provides, in the exemplary embodiment, a top surface providing a substantially central supine section flanked by an upwardly sloping left side section and a substantially symmetrical right side section, the left and right side sections elevated relatively higher than the supine section. The supine section is configured for accommodating a user when lying in a supine position, while each of the left and right side sections is configured for accommodating the user when lying in a respective side position. This configuration enables the pillow to both substantially prevent the user from unintentionally changing sleep positions as well as substantially assist in physically directing the user in selectively transitioning between each of the supine position and left and right side positions as desired, while substantially maintaining the user's head, neck, shoulders, and back in neutral alignment and substantially preventing facial contact with the pillow or underlying sleeping surface.

17 Claims, 9 Drawing Sheets

ANTI-AGING PILLOW

RELATED APPLICATIONS

This application claims priority and is entitled to the filing date of U.S. Provisional application Ser. No. 61/315,302, filed on Mar. 18, 2010 and entitled "Anti-Aging Pillow." The contents of the aforementioned application are incorporated by reference herein.

INCORPORATION BY REFERENCE

Applicant hereby incorporates herein by reference any and all U.S. patents and U.S. patent applications cited or referred to in this application.

BACKGROUND OF THE INVENTION

1. Field of the Invention

Aspects of this invention relate generally to pillows, and more particularly to an anti-aging pillow configured for reducing facial wrinkling.

2. Description of Related Art

In the field of facial plastic and reconstructive surgery, physicians often consult with patients who are seeking remedies for their facial wrinkling. They typically request medical procedures, such as injections of fillers (such as collagen) and muscle immobilizers (such as Botox®), to alleviate this issue, given the fact that they believe their facial wrinkles are a natural result of the aging process. In actuality, however, the facial wrinkling from which many of these patients suffer is caused at least in part by sleep compression lines and sleep surface-associated skin stress. During sleep on a traditional pillow, constant, unavoidable compression, stretching and tugging of a person's facial skin occurs as the weight of their head rests upon the pillow in the prone (i.e., face down) or side sleeping positions. This causes facial compression sleep lines and/or wrinkles which, over time, may become permanent; especially in more mature, less resilient skin. Furthermore, this constant tugging of the skin during sleep on a traditional pillow can increase the rate of loss of dermal elasticity and tone, hastening the general appearance of facial aging. Thus, there is a great need for a pillow that provides a solution to this problem.

The following art defines the present state of this field:

U.S. Pat. No. 4,218,792 to Kogan is generally directed to an orthopaedic pillow made of a block of cellular material having the consistence of a latex foam and having, as seen in plan, substantially the shape of a rectangle or a trapezium, the large side or the large base of which is formed with a concave frontal curvature, the top of the block bounding a concavity in the medium portion of the curved edge and said concavity being continued by a recess.

U.S. Pat. No. 5,018,231 to Wang is generally directed to a contoured pillow designed to accommodate a person sleeping in the supine position or in a side position. The pillow includes a curved ridge along one edge of the pillow to support the neck. The ridge ends in an elliptical depression within the center of the pillow to support the back of a person's head. The elliptical depression allows a person's head a freedom of movement of 45 degrees from either side of its normal vertical position and allows bending of the neck to a certain degree. Along the sides of the depression the pillow is of a greater dimension to support the head when resting on the side of the head. The pillow further includes longitudinal grooves within the side regions of the pillow to prevent a person's ear from being overly compressed against the pillow when resting on one's side. The pillow is of a conventional size and shape and can be used with standard pillow cases, standard sized beds, etc.

U.S. Pat. No. D318,203 to Zaghini is generally directed to the ornamental design for a pillow.

U.S. Pat. No. D381,233 to Torbik is generally directed to the ornamental design for a cervical pillow.

U.S. Pat. No. D388,648 to Bates is generally directed to the ornamental design for a face saving pillow design.

U.S. Pat. No. 5,708,998 to Torbik is generally directed to a cervical pillow for providing proper cervical support whether the sleeper is on his back or on his side. Side sections including cutouts on the left and right of the pillow provide clearance for the airways during side sleeping, and a multi-level construction provides the proper head and neck support for either back or side sleeping positions. A high quality fiber is used in rolled and layered sections to provide comfort for the sleeper and resiliency of the pillow over prolonged use. Dual neck rolls of different diameters allow two sleepers of different neck sizes to alternately use the same pillow.

U.S. Pat. No. 5,727,267 to Keilhauer is generally directed to therapeutic sleeping pillow for a user being generally rectangular with longer front and rear edges and a pair of shorter side edges and upper and lower surfaces. A central portion of the upper surface is provided with a cavity for receiving the user's head, with a neck-supporting ridge formed between the front edge of the pillow and the cavity in the central portion. A wedge-shaped extension of the pillow projects from the front edge to support the upper back of the user. At least one of the pair of shorter side edges has an extension disposed thereon. Each such side extension is provided with a relatively shallow central cavity on the upper surface for receiving and supporting the user's head and a front edge for supporting the user's neck. The upper surface of each such side extension slopes generally downwardly from the front edge towards the rear edge.

U.S. Pat. No. D465,686 to Hwong is generally directed to the ornamental design for a pillow.

U.S. Pat. No. D474,364 to Arceiri is generally directed to the ornamental design for an anti-wrinkle pillow.

U.S. Pat. No. 6,574,809 to Rathbun is generally directed to a pillow which supports a person's head while the person sleeps on their side and does not induce any pressure to a person's face. The pillow includes a body which has a first body portion and a second body portion extending from the first body portion. The first body portion is substantially rectangular-shaped and provides a base for the second body portion. The second body portion defines at least one recess and is positioned such that a plurality of recesses extend from the sides of the pillow towards a lower section of the second body portion.

U.S. Pat. No. D497,507 to Keilhauer is generally directed to the ornamental design for a back sleeper pillow.

U.S. Pat. No. 6,817,049 to Hall is generally directed to a triune, substantially bilaterally symmetrical pillow for a reclining human being configured to provide therapeutic and support and comfort for the head and neck while lying on one's back and side, and allow use in two, opposite orientations to increase durability and functional capacity. A center section is provided with a thin portion, abutted on either side along one axis by two substantially similar convex portions, and abutted on either side along a second axis normal to the first by two substantially identical flat end sections. The end sections have cutaways near the bottoms of their sides, to either side of their connections to the center section, that are designed to accommodate the shoulder of a human user.

U.S. Pat. No. 6,915,539 to Rathbun is generally directed to a pillow which includes a first body portion and a continuous second body portion that extends from the first body portion. The first body portion includes a top edge and a bottom edge connected by a first side edge and a second side edge. The second body portion extends continuously from the top edge to the bottom edge, and continuously between the first and second side edges. The first body portion is substantially rectangular-shaped. The second body portion defines at least one recess, wherein the recess is bordered by a continuous sidewall formed by the second body portion. The recess sidewall extends arcuately from at least one of the first side edge and the second side edge. The pillow also includes an axis of symmetry that extends from the top edge to the pillow bottom edge.

U.S. Pat. No. 7,082,633 to Maarbjerg is generally directed to a pillow adapted for supporting the head of a user. In some embodiments, the pillow can have a visco-elastic body having a center portion elevated with respect to adjacent lateral side portions, each of which can have a recess. The recess can have a concave shape in both lateral and forward/rearward directions of the pillow, can extend and be open to the front and/or lateral sides of the pillow, and can be positioned and shaped to lie beneath the face of a user whose head is at least partially supported by the center portion of the body. Also, the center portion of the pillow can be separated from the laterally adjacent recesses by arcuate-shaped boundaries.

U.S. Pat. No. D529,325 to Maarbjerg is generally directed to the ornamental design for a pillow.

U.S. Pat. No. 7,165,279 to Georgescu is generally directed to a pillow structured for preserving a user's facial beauty and includes a central portion, and upper and lower leg members extending from both the left and right sides of the central portion. The upper and lower leg members on each side are angled relative to one another to form a V-shaped gap. The upper and lower leg members support the user's head and neck, while the face remains over the V-shaped gap avoiding contact with the pillow, and thereby preventing distortion and wrinkling of the facial skin. A case that covers the facial beauty pillow may include straps, allowing the facial beauty pillow to be secured to a conventional pillow to adjust the resting height of the head according to the individual comfort level of the user.

U.S. Pat. No. 7,203,983 to Reeves et al. is generally directed to a pillow apparatus comprising at least one roll portion, a bottom layer extending horizontally from the roll portion, a top layer extending horizontally from the roll portion substantially adjacent to the bottom layer, and a hollow core formed between the bottom layer and the top layer substantially centered within the pillow so as to form a central back-sleeping region and opposite, adjacent side-sleeping regions.

U.S. Pat. No. D558,499 to Maarbjerg is generally directed to the ornamental design for a pillow.

U.S. Pat. Nos. 7,316,041 and 7,516,504 to Guez is generally directed to an osteopathic pillow comprising a body made of an elastically deformable material provided with a top side upon which the head of a user can be rested, and an underside for being placed upon a pillow support. The top side is joined to the underside by at least one shoulder side. Said shoulder side is provided with a shoulder cut-out that forms an opening for the cervical vertebrae of the user when he is lying on his back, and forms an accommodating space for the shoulder of the user when he is lying on his side. The top side preferably comprises a recess that partially accommodates the head of the user, called the head receiving recess.

U.S. Patent Application Publication No. 2009/0139031 to Davis et al. is generally directed to a device for use with a respiratory mask comprising a pillow having at least one recess structured to receive the mask so that the pillow does not exert substantial pressure on the mask, and a cover that at least partially covers the exterior surface of the pillow and substantially follows the contours of the at least one recess. A method of using a respiratory mask comprises providing a pillow having at least one recess, positioning a cover on the pillow so that the cover substantially follows the contours of the at least one recess, positioning a respiratory mask on the head of a user, and positioning the user's head on the cover and pillow such that the mask is received in the at least one recess so that the pillow and cover do not exert substantial pressure on the mask.

While the known prior art does teach various types of anti-wrinkle devices, some of which even aimed at keeping the user's face from contacting the sleeping surface, these prior art devices still have various problems, such as an inability to sufficiently support the weight of the user's head over the sleeping surface, an inability to successfully prevent the user from turning onto his or her face during sleep, an inability to successfully and efficiently enable and physically direct the user in selectively transitioning between a lower neutral supine position and a relatively higher neutral side sleeping position, a tendency to create an uncomfortable sleep experience, and/or a tendency to cause neck and back muscle pain or stiffness upon the user's awakening. Aspects of the present invention fulfill these needs and provide further related advantages as described in the following summary.

SUMMARY OF THE INVENTION

Aspects of the present invention teach certain benefits in construction and use which give rise to the exemplary advantages described below.

The present invention solves the problems described above by providing an anti-aging pillow configured for reducing facial wrinkling, such that a user may lay in a supine position (i.e., on his or her back) or a side position without compressing his or her face against the pillow, thereby preventing compression sleep lines and/or wrinkles and also preventing the facial skin from being tugged during sleep. Furthermore, the pillow is configured for substantially preventing the user from unintentionally changing sleep positions (i.e., moving from a supine position to a side position or from a side position to a face-down prone position). In the event the user intentionally moves from a supine sleeping position to a side position, the pillow is ergonomically configured to physically direct the user from a lower supine position up onto a higher, anatomically fitted, comfortable side sleeping position, which accommodates the user's shoulder, supports the user's neck and automatically positions the user's face so it is suspended from contact with the pillow and underlying sleep surface. The left and right sides of the pillow are symmetrical, enabling the user to side sleep on either his or her left or ride side. While side sleeping, the user is inhibited from rolling forward off the pillow, but is free to roll back into a suitable supine position without inhibition. Thus the user may sleep on his or her back or either side without compression or tension on the facial soft tissues, thereby preventing sleep-associated appearance of facial aging and, with continued use, enabling recovery from damage done to the facial dermis by previous sleeping surfaces the user may have used.

To accomplish this, the pillow provides, in the exemplary embodiment, a top surface providing a substantially central supine section flanked by a left side section and a substantially symmetrical right side section, the left and right side sections elevated relatively higher than the supine section, sloping upwardly and terminating in a left edge and right edge, respectively, of the pillow. The supine section is configured for accommodating a user when lying in the supine position, while each of the left and right side sections is configured for accommodating the user when lying in the left or right side position, respectively. The supine section provides a substantially semi-spherical cephalic indentation sized and configured for supporting a rear area of a head of the user. Each of the left and right side sections provides a side indentation sized and configured such that a perimeter edge of the side indentation contacts a portion of the user's head, substantially adjacent a face of the user, with the user's face elevated and positioned directly over the side indentation. Additionally, a front corner piece and a rear corner piece are integral with each of the left and right edges of the pillow and upwardly extend therefrom, the front and rear corner pieces being configured for substantially preventing the user's head from unintentionally rolling off the respective edge of the pillow. This configuration enables the pillow to substantially assist in physically directing the user in selectively transitioning between each of the supine position, left side position, and right side position as desired, while substantially maintaining the user's head, neck, shoulders, and back in neutral alignment and substantially preventing facial contact with the pillow or the underlying sleeping surface.

A primary objective inherent in the above described apparatus and method of use is to provide advantages not taught by the prior art.

Another objective is to provide such an apparatus that is capable of sufficiently supporting the weight of a user's head over the sleeping surface.

A still further objective is to provide such an apparatus that is capable of substantially preventing the user from turning onto his or her face during sleep;

A still further objective is to provide such an apparatus that is configured for substantially enabling and physically directing the user in selectively transitioning between a lower neutral supine position and a relatively higher neutral side sleeping position.

A still further objective is to provide such an apparatus that is configured for creating a substantially comfortable sleep experience for the user.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

DETAILED DESCRIPTION OF THE INVENTION

The above described drawing figures illustrate aspects of the invention in at least one of its exemplary embodiments, which are further defined in detail in the following description.

Figure 1:
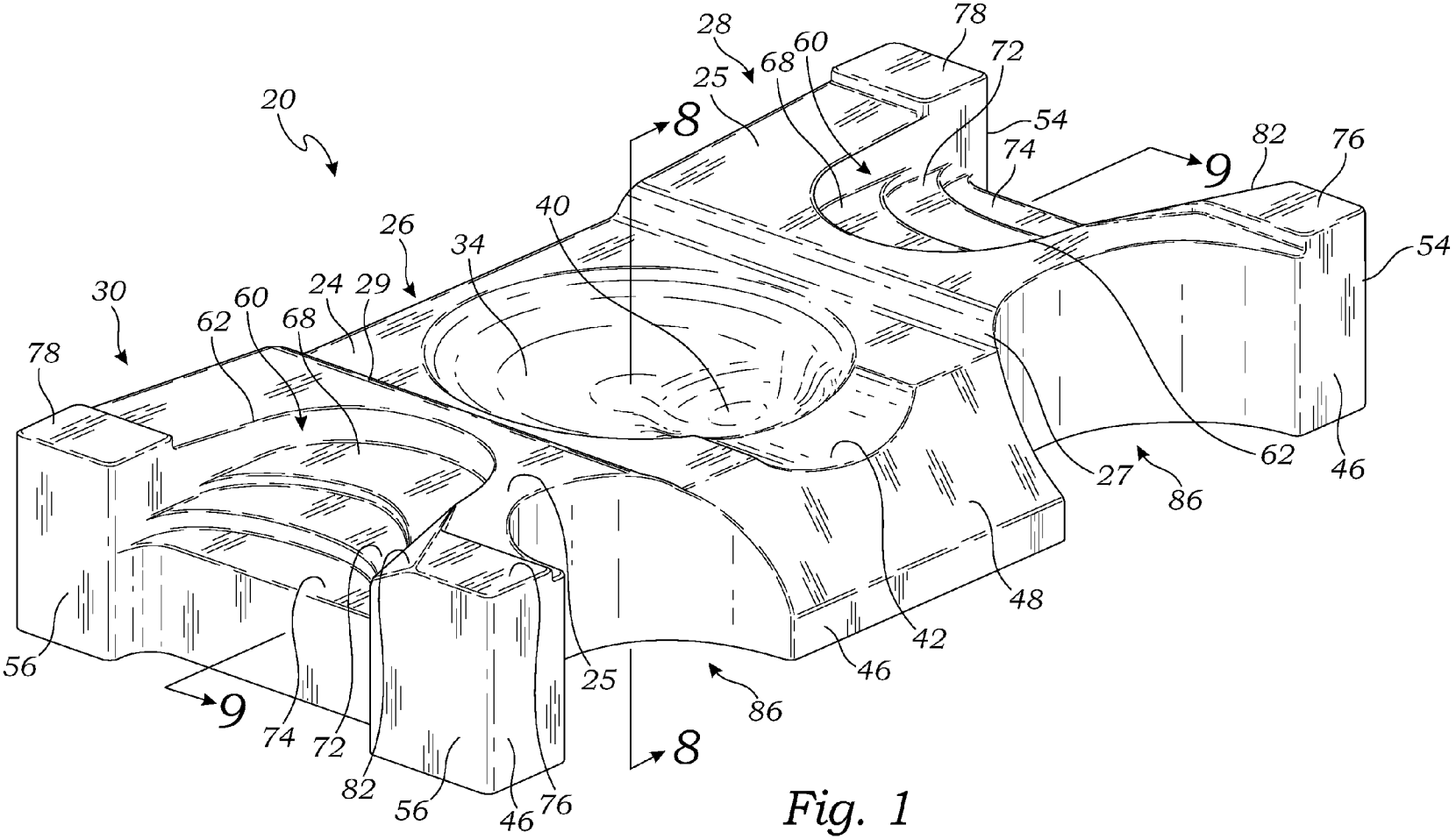
FIG. 1 is a perspective view of an exemplary embodiment of the present invention.

Turning now to FIG. 1, there is shown a perspective view of an exemplary embodiment of an anti-aging pillow 20. The pillow 20 is preferably made of a soft, resilient material, such as flexible foam or the like. In the exemplary embodiment, the resilient material is a flexible, open cell, high resiliency polyurethane foam having an indent force deflection (IFD) between 36 and 45 pounds. It should be noted that in further embodiments, other types of materials, now known or later developed, that are capable of accomplishing the functions herein described, such as inflatable bladders, may be substituted, whether or not having a particular IFD or other material property. In further embodiments, the pillow 20 may optionally provide a pillow cover (not shown) removably or permanently engaged therewith and configured for protecting the pillow 20.

Figure 7:
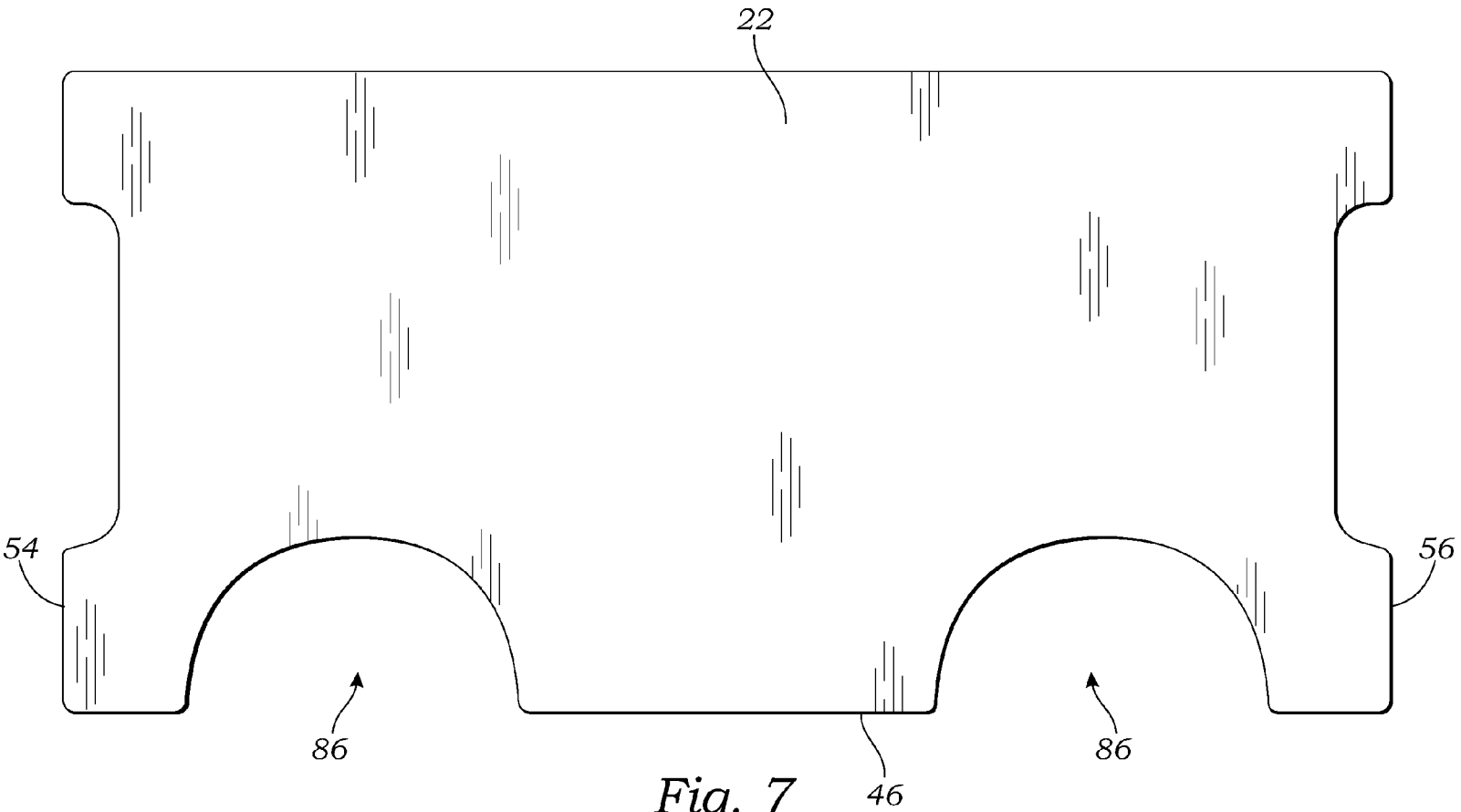
FIG. 7 is a bottom view thereof.
Figure 8:
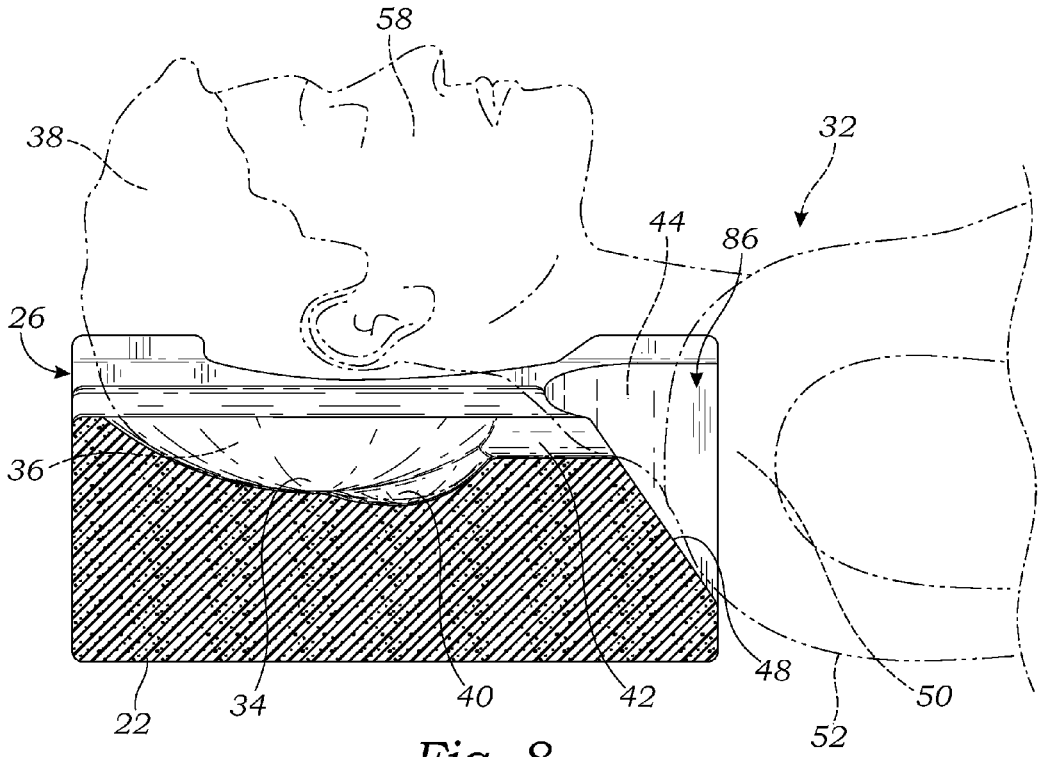
FIG. 8 is a cross-sectional view taken along line 8-8 of FIG. 1, showing a user in phantom positioned on a supine section of the exemplary embodiment of the present invention.

A bottom surface 22 of the pillow 20 (FIG. 7) is preferably flat and configured for resting on a relatively flat sleeping surface (not shown), such as a mattress. In further embodiments, not shown, the bottom surface 22 may provide a plurality of ridges or other means for creating sufficient friction between the bottom surface 22 and the sleeping surface. A top surface 24 of the pillow 20 (FIG. 1) provides, in the exemplary embodiment, a substantially central supine section 26 flanked by a left side section 28 and a right side section 30. The left side section 28 is configured for accommodating a user 32 when lying on his or her left side. The supine section 26 is configured for accommodating the user 32 when lying on his or her back (i.e., in a supine position), as shown in FIG. 8. The right side section 30 is substantially symmetrical with the left side section 28 and configured for accommodating the user 32 when lying on his or her right side, as shown in FIG. 10.

Figure 6:
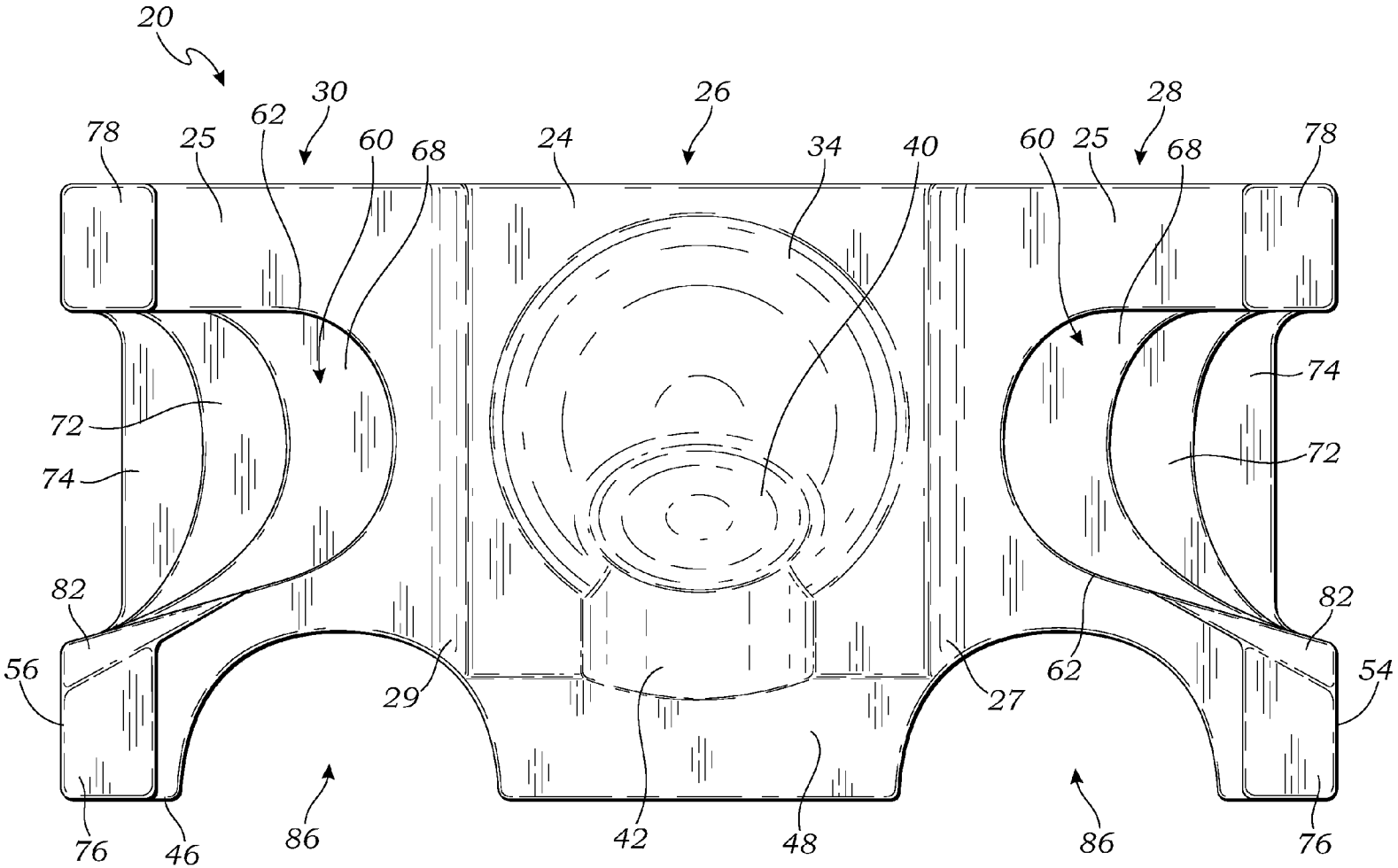
FIG. 6 is a top view thereof.

As shown best in FIGS. 1 and 6, the supine section 26, in the exemplary embodiment, provides a substantially semi-spherical cephalic indentation 34 sized and configured for comfortably accepting and providing support to a rear area 36 of a head 38 of the user 32 (as best shown in FIG. 8). The cephalic indentation 34 preferably provides a relatively deeper, substantially elliptical occipital indentation 40 positioned and configured for providing occipital support in order to hold the user's head 38 in a comfortable, substantially neutral supine position, without flexion or hyperextension. The supine section 26 further provides a laterally curved, concave cervical portion 42 adjacent the cephalic and occipital indentations 34 and 40 and configured for providing neutral cervical alignment and support to a neck 44 of the user 32 (FIG. 8). Additionally, a front edge 46 of the pillow 20 provides a downwardly sloping back portion 48 adjacent the cervical portion 42. The back portion 48 is positioned and configured for supporting at least a portion of the user's neck 44, shoulders 50, and back 52 (FIG. 8), providing further comfort thereto. In combination, the cephalic indentation 34, occipital indentation 40, cervical portion 42 and back portion 48 are configured for maintaining neutral cervical curvature and alignment for the user's bodily comfort, thereby reducing the impulse to shift positions during sleep while the user 32 is in the supine position (FIG. 8).

Figure 2:
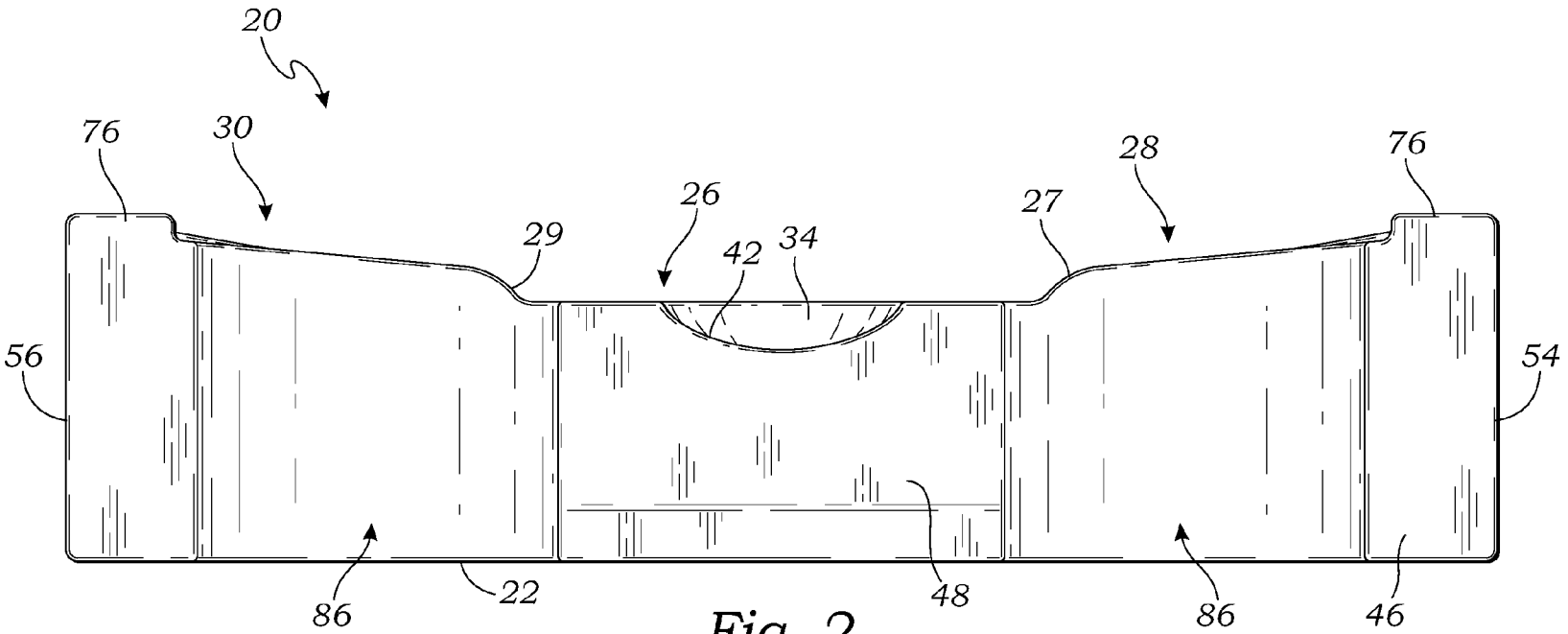
FIG. 2 is a front elevational view thereof.
Figure 3:
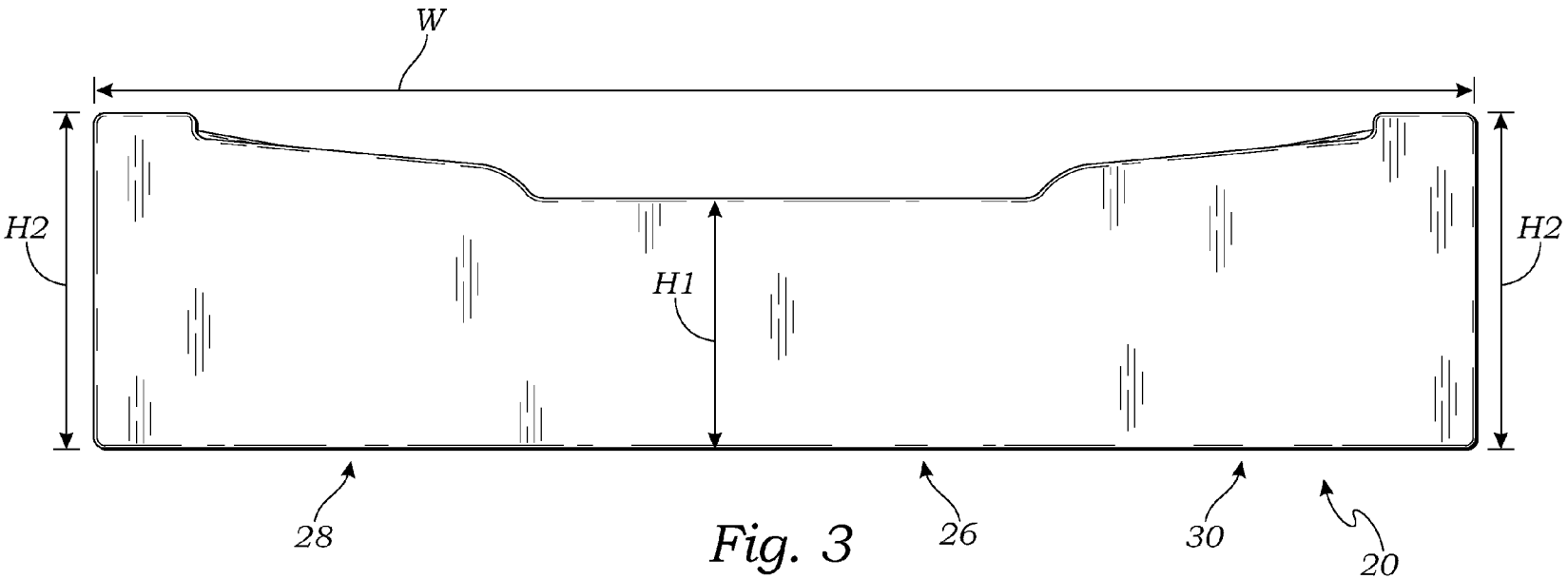
FIG. 3 is a rear elevational view thereof.

As shown best in FIGS. 2 and 3, each of the left and right side sections 28 and 30 are preferably elevated relatively higher than the supine section 26 and slope upwardly from the supine section 26 toward left and right edges 54 and 56, respectively, of the pillow 20. The upwardly sloped left and right side sections 28 and 30, in combination with the cervical portion 42 and cephalic and occipital indentations 34 and 40, operate to inhibit the user 32 from unintentionally moving from the supine position into a side position, particularly the transverse convexly curved transition surfaces 27 and 29 formed between the supine section 26 and the respective left and right side sections 28 and 30. Furthermore, this configuration assists in automatically directing the head 38 and face 58 of the user 32 from the supine position into the proper, relatively higher left or right side sleeping position as desired, and vice versa, while also creating a supportive, anatomically fitted and comfortable sleep/rest surface that substantially inhibits facial contact with the pillow 20 or the underlying sleeping surface in virtually any sleep position, and further inhibits the user 32 from unintentionally rolling into an undesirable position, such as face down or off the left or right edges 54 or 56 of the pillow 20.

Figure 4:
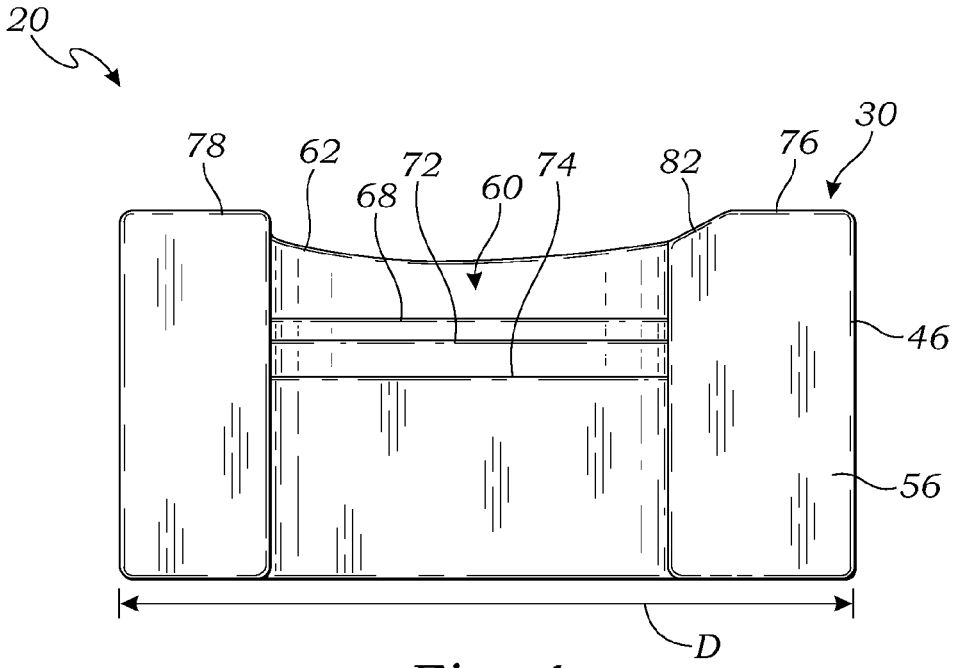
FIG. 4 is a right side elevational view thereof.
Figure 5:
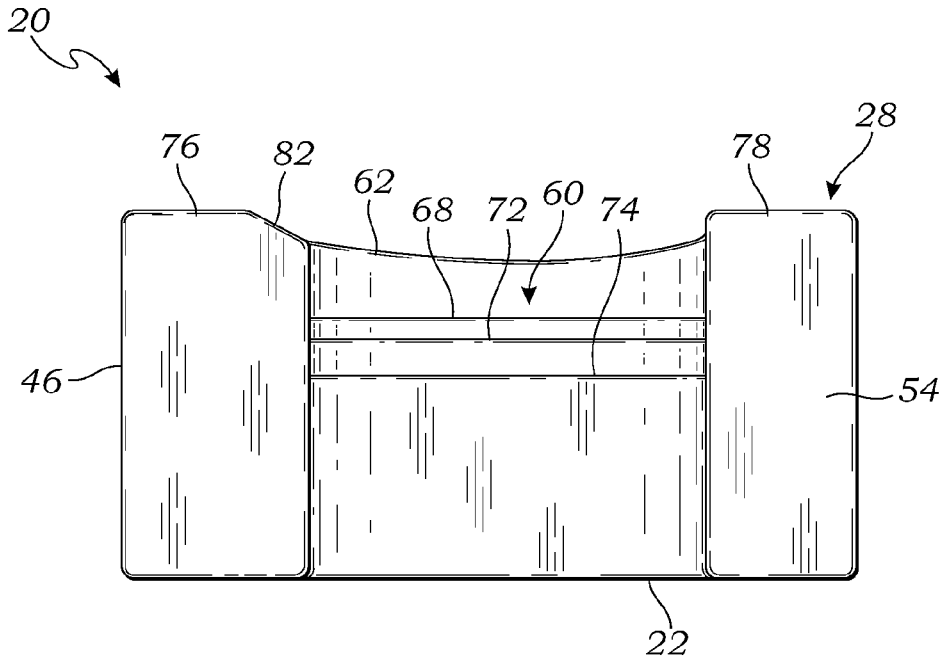
FIG. 5 is a left side elevational view thereof.
Figure 10:
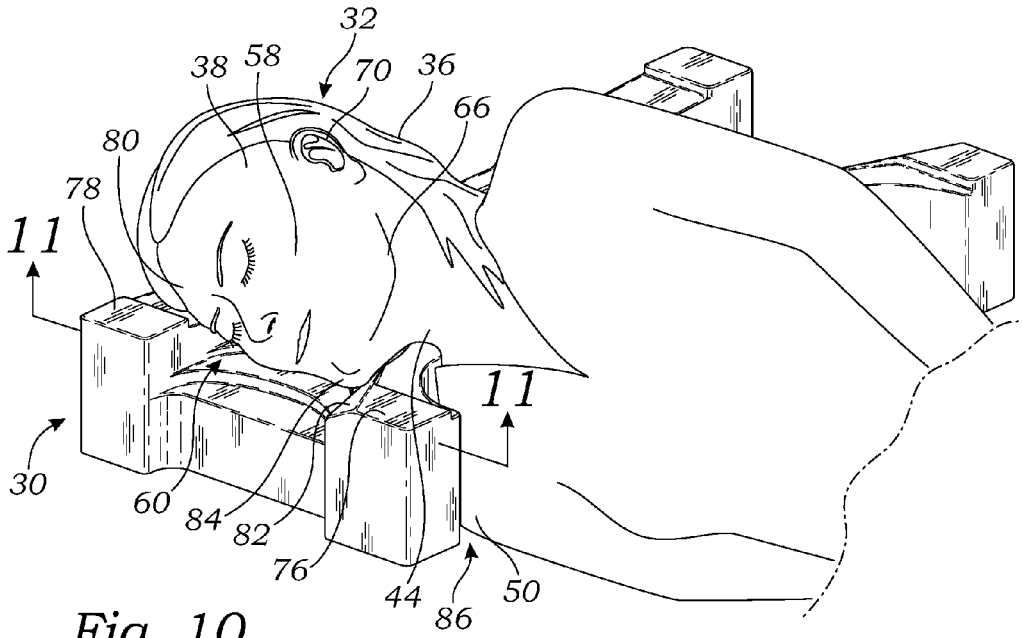
FIG. 10 is a perspective view of the exemplary embodiment of the present invention, showing a user positioned on the right side section thereof.
Figure 11:
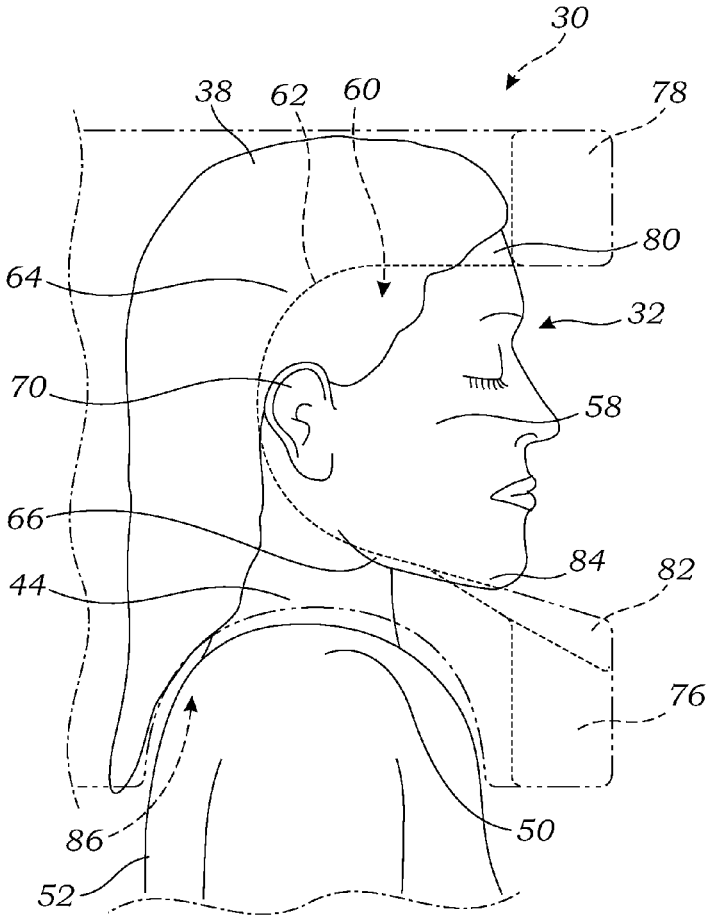
FIG. 11 is a cross-sectional view taken along line 11-11 of FIG. 10, just above a first step of the right side section.

Turning again to FIG. 1 and with further reference to FIGS. 4 and 5, the left and right side sections 28 and 30 each also provide a stepwise side indentation 60 sized and configured such that, when the user 32 is resting in the side position (FIG. 10), a sloping portion 25 of the top surface 24 of the pillow 20, proximal a perimeter edge 62 of the side indentation 60, supports the user's neck 44 and a side area 64 of the user's head 38 and jaw line 66, adjacent the user's face 58, with the user's face 58 elevated and positioned directly over the side indentation 60 (FIGS. 10 and 11). Thus, as illustrated best in the sectional view of FIG. 11, the user's face 58 remains substantially not contacted by either the pillow 20 or the underlying sleeping surface on which the pillow 20 is positioned, instead being essentially suspended over the space formed by the side indentation 60. In addition to substantially eliminating facial contact or pressure, each of the side indentations 60 is also configured for maintaining the structural integrity of the respective side section 28 or 30 such that the user's head 38 remains sufficiently supported in a substantially neutral position during use, without flexion or hyperextension. Preferably, as shown best in FIGS. 1 and 6, each of the side indentations 60 has a relatively arcuate shape. However, in alternate embodiments, not shown, other shapes and dimensions for the side indentations 60 may be substituted, so long as the side indentations 60 enable the user's face 58 to remain substantially not contacted by either the pillow 20 or the underlying sleeping surface during use.

Figure 9A:
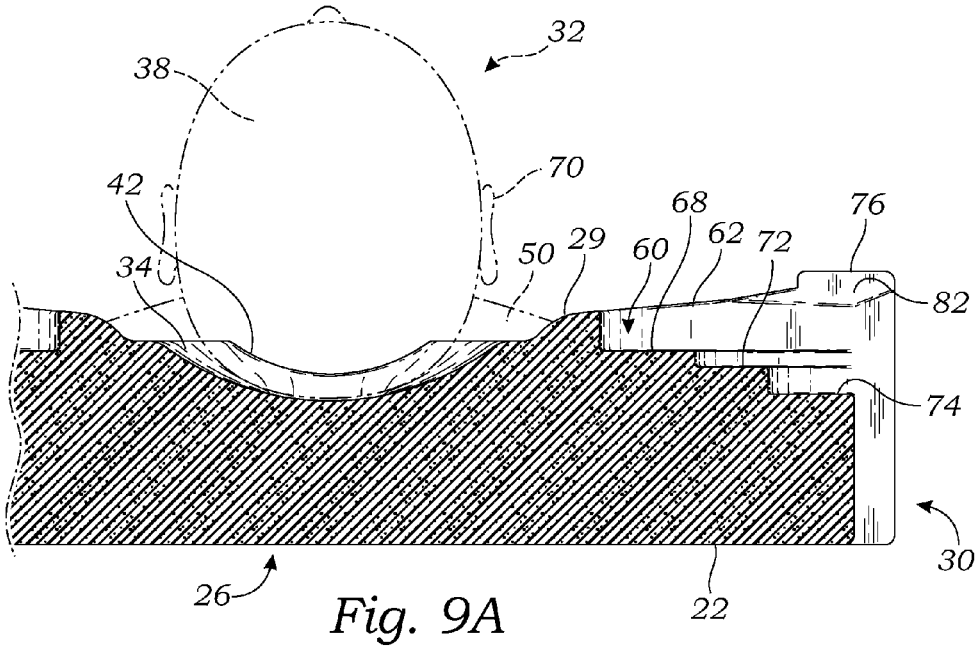
FIGS. 9A-9C are cross sectional views taken along line 9-9 of FIG. 1, showing a user in phantom transitioning from the supine section to a right side section of the exemplary embodiment of the present invention.
Figure 9B:
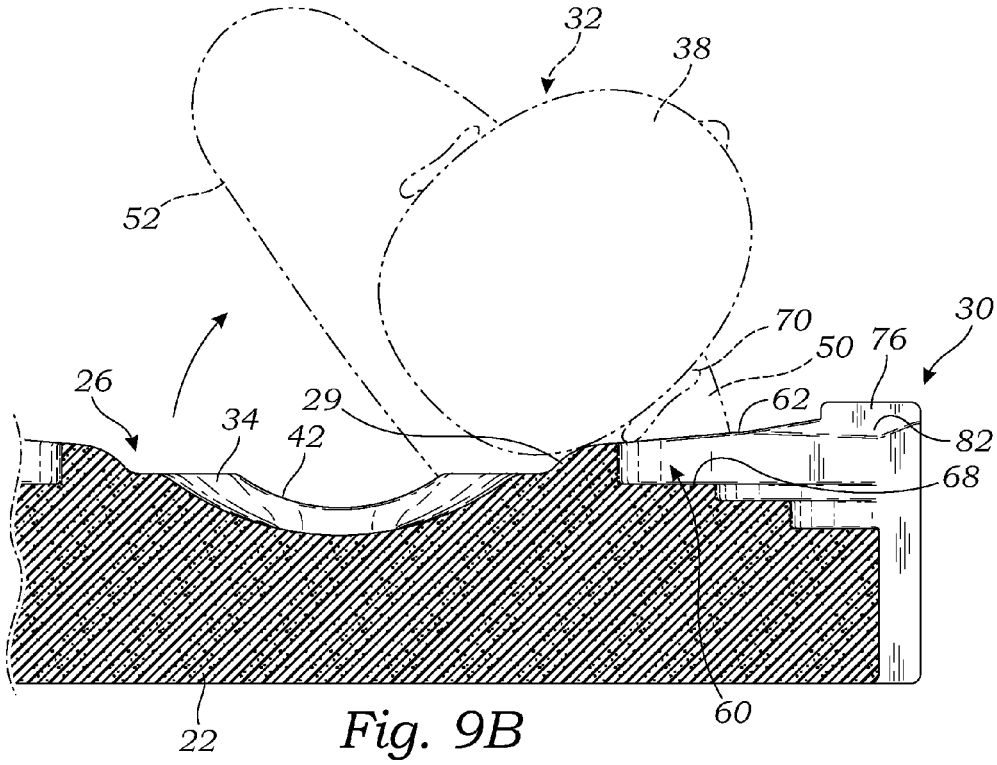
Figure 9C:
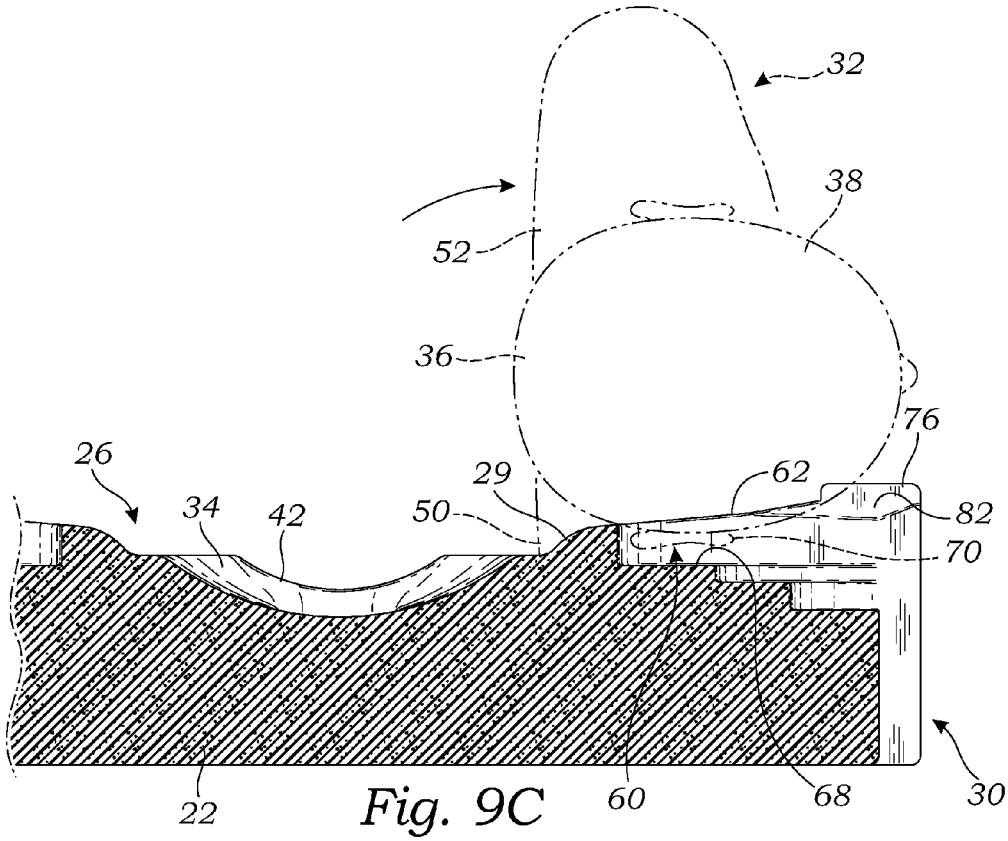

As shown best in FIG. 1, a first step 68 of the stepwise side indentation 60 is sized and configured for gently contacting an ear 70 of the user 32, as the user 32 is lying in the side position. It should be noted that, depending on the size of the user 32, the user's ear 70 may not necessarily contact the first step 68, as shown in FIG. 9C. In alternate embodiments, the first step 68 may provide an ear indentation (not shown) sized and configured for comfortably accepting and further supporting the user's ear 70. Turning to FIGS. 4 and 5, each of the side indentations 60, in the exemplary embodiment, further provides a second step 72 and third step 74 each positioned relatively lower than the first step 68 and configured for providing additional structural integrity to the corresponding side section 60 while not contacting the user's face 58 during use. Preferably, each of the first, second and third steps 68, 72 and 74 has a relatively arcuate shape, shown best in FIG. 6, similar to the side indentation 60. However, in further embodiments, not shown, alternate shapes and dimensions may be substituted, so long as the user's face 58 is able to remain substantially not contacted by either the pillow 20 or the underlying sleeping surface during use. For example, the third step 74 may, in alternate embodiments, not shown, extend all the way to the corresponding edge 54 or 56 of the pillow 20. In still further embodiments, also not shown, the second step 72 and/or third step 74 may be omitted altogether or constructed or formed so as to blend together as an inclined surface.

Referring once more to FIG. 1, each of the left and right side sections 28 and 30 further provides, in the exemplary embodiment, a front corner piece 76 and a rear corner piece 78 integral with the corresponding edge 54 or 56 of the pillow 20 and slightly upwardly extending therefrom. The front and rear corner pieces 76 and 78 are configured for further preventing the user's head 38 from unintentionally rolling forward, off the pillow 20 or out of position, when the user 32 is lying in the side position. More specifically, as shown best in FIG. 10, each of the rear corner pieces 78 is configured for selectively and partially contacting an upper area 80 of the user's head 38, while each of the front corner pieces 76 is configured for selectively and partially contacting a lower area of the user's head 38. Additionally, each of the front corner pieces 76 provides a chamfered edge 82 partially integral with the perimeter edge 62 of the side indentation 60 and configured for selectively and partially contacting a chin 84 of the user 32 for both comfort and maintaining proper side-sleep positioning.

Turning again to FIGS. 1 and 6 together, the front edge 46 of the pillow 20 defines, in an exemplary embodiment, a pair of shoulder cutouts 86. The shoulder cutouts 86 preferably flank the back portion 48, proximal the side indentations 60, and are sized and configured for receiving at least part of one of the user's shoulders 50 when the user 32 is resting in the side position (FIGS. 10 and 11). Thus, the shoulder cutouts 86 provide sufficient shoulder space so the user 32 can lie comfortably and properly in the side position. Furthermore, the shoulder cutouts 86 are preferably positioned adjacent the supine section 26 such that, as the user 32 rolls and transitions from the supine position to the side position, as shown in the sequence of FIGS. 9A-9C, the user's shoulder 50 naturally falls comfortably into the appropriate shoulder cutout 86, maintaining proper cervical alignment and support.

In the exemplary embodiment, referring to FIG. 3, the supine section 26 of the pillow 20 preferably has a height H1 sufficient to accommodate the user 32 in the supine position while substantially maintaining the user's head 38, neck 44, shoulders 50, and back 52 in proper neutral alignment (FIG. 8). Similarly, each of the side sections 28 and 30 preferably has a height H2 greater than H1 sufficient to accommodate the user 32 in the side position while substantially maintaining the user's head 38, neck 44, shoulders 50, and back 52 in proper neutral alignment (FIG. 10), as well as effectively inhibiting unintentional rolling from the back or supine position to a side sleeping position, as discussed above. Furthermore, a width W of the pillow 20 is preferably such that the user 32 is able to naturally roll from the proper supine position on the supine section 26 to the proper side position on one of the side sections 28 or 30, as shown in the sequence of FIGS. 9A-9C, without the user 32 having to physically lift or reposition themselves to any significant extent. For example, in the exemplary embodiment, the height H1 of the supine section 26 is approximately four inches (4"), the height H2 of the side sections 28 and 30 is approximately six inches (6") at their highest point (the side sections 28 and 30 sloping downwardly toward the supine section 26 as discussed above), and the width W of the pillow 20 is approximately twenty five inches (25"). Additionally, a depth D of the pillow 20 (FIG. 4) is preferably twelve inches (12") in the exemplary embodiment. It should be noted that the above described dimensions and geometries are merely intended to illustrate an exemplary embodiment, and should in no way be interpreted as limiting the present invention.

It should also be noted that the various features of each of the above-described embodiments may be combined in any logical manner and are intended to be included within the scope of the present invention. Once again, it will be appreciated by those skilled in the art that a number of other variations of the elements and aspects of the present invention, such as to accommodate users of different ages or sizes or having particular needs or anatomical traits, are possible without departing from the spirit and scope of the invention, both in terms of the geometrical configuration of the pillow and its material of construction. Relatedly, it should be further noted that while a compressible material such as foam or an inflatable construction are contemplated, for simplicity and illustration of the principles of the invention, the drawings depicting the pillow 20 in use (FIGS. 8-11) do not show compression, distortion or other physical change to the pillow 20 as a user 32 lies on it; though those skilled in the art will appreciate that, in actuality, there will be some such changes to the pillow's shape under load (i.e., in use), such as the compression of edges or surfaces with which the user's head 38 is in contact.

To summarize, regarding the exemplary embodiments of the present invention as shown and described herein, it will be appreciated that an anti-aging pillow is disclosed and configured for reducing facial wrinkling, such that a user may lay on his or her back or side without compressing his or her face against the pillow, thereby preventing compression sleep lines and/or wrinkles and also preventing the facial skin from being tugged during sleep. Because the principles of the invention may be practiced in a number of configurations beyond those shown and described, it is to be understood that the invention is not in any way limited by the exemplary embodiments, but is generally directed to an anti-aging pillow and is able to take numerous forms to do so without departing from the spirit and scope of the invention. Furthermore, the various features of each of the above-described embodiments may be combined in any logical manner and are intended to be included within the scope of the present invention. It will also be appreciated by those skilled in the art that the present invention is not limited to the particular geometries and materials of construction disclosed, but may instead entail other functionally comparable structure, now known or later developed, without departing from the spirit and scope of the invention.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventors believe that the claimed subject matter is the invention.

What is claimed is:

1. A pillow configured for reducing facial wrinkling for a user, the pillow comprising:

a top surface providing a substantially central supine section flanked by a left side section and a substantially symmetrical right side section, the left and right side sections elevated relatively higher than the supine section, laterally sloping upwardly therefrom and terminating in a left edge and right edge, respectively, of the pillow;

the supine section configured for accommodating the user when lying in a supine position and comprising a substantially semi-spherical cephalic indentation sized and configured for supporting a rear area of a head of the user;

each of the left and right side sections configured for accommodating the user when lying in a side position and comprising:

a side indentation sized and configured such that a perimeter edge of the side indentation contacts a portion of the user's head, substantially adjacent a face of the user, with the user's face elevated and positioned directly over the side indentation; and a front corner piece and a rear corner piece integral with the respective edge of the pillow and upwardly extending from the top surface of the pillow, said front and rear corner pieces configured for substantially preventing the user's head from unintentionally rolling off the respective edge of the pillow;

whereby, with a bottom surface of the pillow positioned on a relatively flat sleeping surface, the pillow is capable of substantially assisting in physically directing the user in selectively transitioning between each of the supine position, left side position, and right side position as desired, while substantially maintaining the user's head, neck, shoulders, and back in neutral alignment and substantially preventing facial contact with the pillow or the underlying sleeping surface.

2. The pillow of claim 1, wherein the cephalic indentation provides a relatively deeper, substantially elliptical occipital indentation positioned therewithin and configured for providing occipital support to the user's head.

3. The pillow of claim 2, wherein the supine section further comprises a laterally curved, concave cervical portion positioned adjacent the cephalic and occipital indentations and configured for providing neutral cervical alignment and support to a neck of the user.

4. The pillow of claim 3, wherein a front edge of the pillow provides a downwardly sloping back portion adjacent the cervical portion, the back portion positioned and configured for supporting at least a portion of the user's neck, shoulders, and back.

5. The pillow of claim 4, further comprising a pair of shoulder cutouts flanking the back portion, proximal the side indentations, and configured for receiving at least part of one of the user's shoulders and supporting the user's neck when the user is lying in one of the left or right side positions.

6. The pillow of claim 5, wherein the shoulder cutouts are positioned adjacent the supine section such that, as the user selectively rolls and transitions from the supine position to one of the left or right side positions, the user's shoulder naturally falls into the respective shoulder cutout, substantially maintaining proper cervical alignment and support.

7. The pillow of claim 1, wherein each of the side indentations has a relatively arc-shaped cross section.

8. The pillow of claim 1, wherein each of the side indentations provides a first step positioned relatively lower than the perimeter edge and configured for gently contacting an ear of the user when the user is lying in one of the left or right side positions.

9. The pillow of claim 8, wherein each of the side indentations provides an at least one further step positioned relatively lower than the first step and configured for providing additional structural integrity to the respective side section while not contacting the user's face during use.

10. The pillow of claim 9, wherein each of the first and further steps has a relatively arc-shaped cross section.

11. The pillow of claim 1, wherein each of the front corner pieces provides a chamfered edge partially integral with the perimeter edge of the respective side indentation and configured for selectively and partially contacting a chin of the user.

12. The pillow of claim 1, further comprising a pair of transverse convexly curved transition surfaces formed between the supine section and each of the left and right side sections, the transition surfaces configured for substantially preventing the user from unintentionally moving out of the supine position and into one of the left or right side positions.

13. The pillow of claim 1, wherein each of the rear corner pieces is configured for selectively and partially contacting an upper area of the user's head, and each of the front corner pieces is configured for selectively and partially contacting a lower area of the user's head.

14. The pillow of claim 1, wherein each of the supine section and left and right side sections has a height sufficient to accommodate the user when in the supine and side positions, respectively, while substantially maintaining the user's head, neck, shoulders, and back in neutral alignment, and the pillow has a width sufficient to allow the user to naturally roll from the supine position, on the supine section, to the side position, on one of the left or right side sections, without the user having to physically lift or reposition himself or herself to any significant extent.

15. The pillow of claim 14, wherein the height of the supine section is approximately four inches, the height of each of the left and right side sections is approximately six inches at their highest point, and the width of the pillow is approximately twenty five inches.

16. A pillow configured for reducing facial wrinkling for a user, the pillow comprising:

a top surface providing a substantially central supine section flanked by a left side section and a substantially symmetrical right side section, the left and right side sections elevated relatively higher than the supine section, sloping upwardly therefrom and terminating in a left edge and right edge, respectively, of the pillow;

a pair of transverse convexly curved transition surfaces formed between the supine section and each of the left and right side sections, the transition surfaces configured for substantially preventing the user from unintentionally moving out of the supine position and into one of the left or right side positions;

the supine section configured for accommodating the user when lying in a supine position and comprising:

a cephalic indentation sized and configured for supporting a rear area of a head of the user, the cephalic indentation providing a relatively deeper, substantially elliptical occipital indentation positioned therewithin and configured for providing occipital support to the user's head; and a laterally curved, concave cervical portion positioned adjacent the cephalic and occipital indentations and configured for providing neutral cervical alignment and support to a neck of the user;

each of the left and right side sections configured for accommodating the user when lying in a side position and comprising:

a substantially arcuate, stepwise side indentation sized and configured such that a perimeter edge of the side indentation contacts a portion of the user's head, substantially adjacent a face of the user, with the user's face elevated and positioned directly over the side indentation;

the side indentation providing an at least one step positioned relatively lower than the perimeter edge and configured for providing additional structural integrity to the respective side section while not contacting the user's face during use;

a front corner piece and a rear corner piece integral with the respective edge of the pillow and upwardly extending from the top surface of the pillow, said front and rear corner pieces configured for substantially preventing the user's head from unintentionally rolling off the respective edge of the pillow; and the front corner piece providing a chamfered edge partially integral with the perimeter edge of the side indentation and configured for selectively and partially contacting a chin of the user;

a front edge of the pillow providing a downwardly sloping back portion adjacent the cervical portion, the back portion positioned and configured for supporting at least a portion of the user's neck, shoulders, and back; and a pair of shoulder cutouts flanking the back portion, proximal the side indentations, and configured for receiving at least part of one of the user's shoulders and supporting the user's neck when the user is lying in one of the left or right side positions;

whereby, with a bottom surface of the pillow positioned on a relatively flat sleeping surface, the pillow is capable of substantially assisting in physically directing the user in selectively transitioning between each of the supine position, left side position, and right side position as desired, while substantially maintaining the user's head, neck, shoulders, and back in neutral alignment and substantially preventing facial contact with the pillow or the underlying sleeping surface.

17. A pillow configured for reducing facial wrinkling for a user, the pillow comprising:

a top surface providing a substantially central supine section flanked by a left side section and a substantially symmetrical right side section, the left and right side sections elevated relatively higher than the supine section, sloping upwardly therefrom and terminating in a left edge and right edge, respectively, of the pillow;

a pair of transverse convexly curved transition surfaces formed between the supine section and each of the left and right side sections, the transition surfaces configured for substantially preventing the user from unintentionally moving out of the supine position and into one of the left or right side positions;

the supine section configured for accommodating the user when lying in a supine position and comprising a cephalic indentation sized and configured for supporting a rear area of a head of the user;

each of the left and right side sections configured for accommodating the user when lying in a side position and comprising:

a side indentation sized and configured such that a perimeter edge of the side indentation contacts a portion of the user's head, substantially adjacent a face of the user, with the user's face elevated and positioned directly over the side indentation;

a front corner piece and a rear corner piece integral with the respective edge of the pillow and upwardly extending from the top surface of the pillow, said front and rear corner pieces configured for substantially preventing the user's head from unintentionally rolling off the respective edge of the pillow; and the front corner piece providing a chamfered edge partially integral with the perimeter edge of the side indentation and configured for selectively and partially contacting a chin of the user;

whereby, with a bottom surface of the pillow positioned on a relatively flat sleeping surface, the pillow is capable of substantially assisting in physically directing the user in selectively transitioning between each of the supine position, left side position, and right side position as desired, while substantially maintaining the user's head, neck, shoulders, and back in neutral alignment and substantially preventing facial contact with the pillow or the underlying sleeping surface.

* * * * *